US005333803A

United States Patent [19]

Planeta

[11] Patent Number: 5,333,803

[45] Date of Patent: Aug. 2, 1994

[54] STRIP UNWINDING MACHINE

[76] Inventor: Mirek Planeta, 170 Traders Blvd., Mississauga, Ontario L4Z 1W7, Canada

[21] Appl. No.: 995,093

[22] Filed: Dec. 22, 1992

[51] Int. Cl.[5] ..... B65H 19/18

[52] U.S. Cl. ..... 242/555.3; 242/559.1; 242/560; 242/564.5

[58] Field of Search ..... 242/58.1, 58.2, 58.6, 242/58.3, 65, 56 R

[56] References Cited

U.S. PATENT DOCUMENTS

| | | | |
|---|---|---|---|
| 2,361,795 | 10/1944 | Rosen | 242/58.5 |
| 3,163,375 | 12/1964 | Link | 242/58.2 |
| 3,679,524 | 7/1972 | Bassett et al. | 242/58.3 |
| 3,743,206 | 7/1973 | Riegger | 242/58.2 |
| 5,031,666 | 7/1991 | Raaijmakers et al. | 242/58.3 |

*Primary Examiner*—Daniel P. Stodola
*Assistant Examiner*—Eileen A. Dunn
*Attorney, Agent, or Firm*—Rogers & Scott

[57] ABSTRACT

A strip unwinding machine has laterally spaced tracks for receiving opposite ends of a shaft on which a roll of strip mounted. A transfer assembly moves a new roll and shaft along the tracks from a loading position to an unwinding position, and a rotatable unwinding roller is located at the unwinding position. The transfer assembly also urges the roll against the unwinding roller to cause the roll to be rotated thereby with consequent unwinding to the strip from the roll. A raising assembly which rotates completely around the unwinding roller raises a nearly empty roll and shaft at the unwinding position upwardly from the tracks and from the transfer assembly while maintaining engagement of the roll with the unwinding roller to enable a new roll and shaft to be brought to the unwinding position by the transfer assembly. A cutting assembly carried by the raising assembly cuts the strip from the nearly empty roll when the new roll is brought into engagement with the unwinding roller by the transfer assembly to cause the last portion of the strip unwound from the nearly empty roll to adhere to an initial portion of the strip on the new roll so as to continuously feed strip from the machine.

4 Claims, 5 Drawing Sheets

STRIP UNWINDING MACHINE

FIELD OF THE INVENTION

This invention relates to strip unwinding machines, that is to say machines which supply a continuous strip or web of thin flexible material such as plastic film, metal foil or paper to a further machine such as a printing machine or laminating machine by unwinding successive rolls of strip.

DESCRIPTION OF THE RELATED ART

In such machines, the strip is usually unwound from a large roll thereof wound on a tubular core. Such rolls may have a length of up to about 300 ins (750 cm) and a weight of up to about 8,000 lbs (3600 kg). Machines such as printing machines or laminating machines to which the strip is supplied by the unwinding machine usually require strip to be supplied at a constant speed and tension. When nearly all the strip on a roll has been unwound from the core, it is necessary for the machine to stop unwinding strip from the almost empty roll and to commence unwinding strip from a new roll without any interruption in the supply of strip to the further machine. It is thus necessary for the strip to be cut from the nearly empty roll and to be secured to the strip on the new roll to ensure continuous supply of strip.

It is an object of the present invention to provide an improved machine for this purpose.

SUMMARY OF THE INVENTION

According to the present invention, a strip unwinding machine for supplying a continuous strip of thin flexible material by unwinding strip from successive rolls thereof comprises a pair of laterally spaced tracks for receiving opposite end portions of a shaft on which a roll of strip is mounted, a transfer assembly for moving a new roll and shaft along said tracks from a loading position to an unwinding position, a rotatable unwinding roller at the unwinding position, means for rotating the unwinding roller, said transfer assembly also being operable to urge the roll against the unwinding roller and cause the roll to be rotated thereby with consequent unwinding of the strip from the roll, at least one guide roller to guide the unwound strip around a portion of the unwinding roller and then out of the machine, a raising assembly operable to raise a nearly empty roll and shaft at the unwinding position upwardly from said tracks and from said transfer assembly while maintaining engagement of the roll with the unwinding roller to enable a new roll and shaft to be brought to the unwinding position by the transfer assembly, and a cutting assembly operable to cut the strip from the nearly empty roll when the new roll is brought into engagement with the unwinding roller by the transfer assembly to cause the last portion of the strip unwound from the nearly empty roll to adhere to an initial portion of the strip on the new roll so as to continuously feed strip from the machine.

The cutting assembly may be carried by the raising assembly. The raising and cutting assemblies may be mounted for rotation around the unwinding roller so as to rotate completely therearound to effect changeover of strip feed from a nearly empty roll to a new roll.

The raising assembly may comprise a pair of side arms on opposite sides of the unwinding roller and each having an end mounted for rotation about the axis of rotation of the unwinding roller and a pair of support arms at the other ends of the side arms for raising a nearly empty roll and shaft from the tracks and from the transfer assembly by engagement with opposite ends of the shaft, said cutting assembly comprising a knife mounted between the side arms and operable to cut the strip.

A removal assembly may be provided to remove the nearly empty roll and shaft from the raising assembly when the cutting assembly has operated to cut the strip. The removal assembly may comprise pivotally mounted arms engagable with opposite ends of the shaft of the nearly empty roll.

BRIEF DESCRIPTION OF THE DRAWINGS

One embodiment of the invention will now be described, by way of example, with reference to the accompanying drawings, of which.

DESCRIPTION OF THE PREFERRED EMBODIMENT

Figure 1:
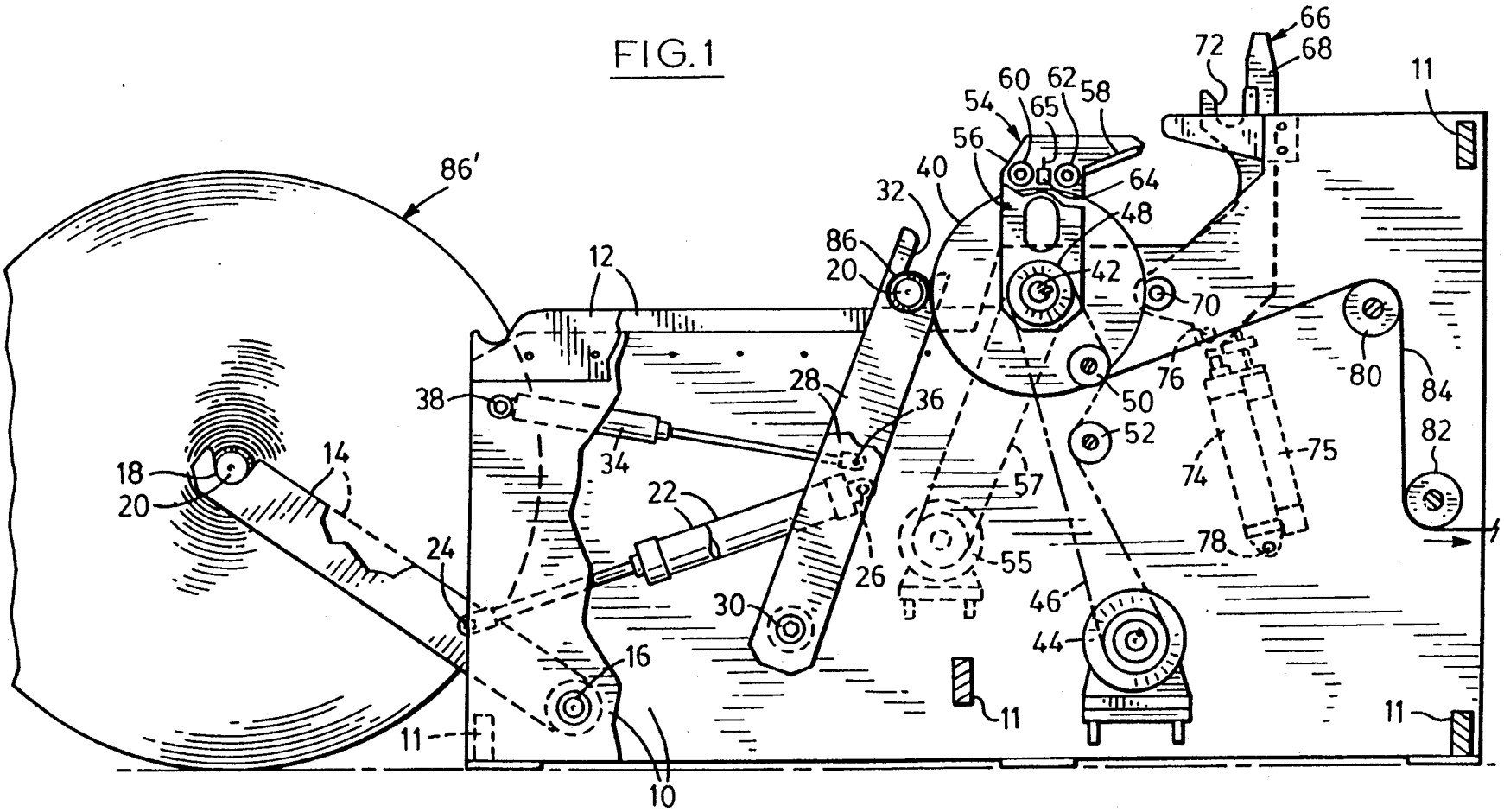
FIG. 1 is a diagrammatic side view of a strip unwinding machine showing strip being unwound from a nearly empty roll.

Referring to the drawings, a strip unwinding machine comprises a pair of transversely spaced side frame members 10 secured by transversely-extending tie members 11 in a manner which will be readily apparent to a person skilled in the art. At the front end of the machine, tracks 12 are mounted on the tops of the side frame members 10. The front end of the machine also has a loading assembly comprising a pair of transversely spaced loading arms 14 whose lower ends are pivotally connected at 16 to the respective side frame members 10 and whose upper ends have recesses 18 to receive opposite end portions of a roll shaft 20. A hydraulically operated piston and cylinder assembly 22 is pivotally connected between each loading arm and the respective side frame member 10 at 24 and 26 respectively for loading a new roll and shaft onto the tracks 12 as will be described in more detail later.

The machine also has a roll transfer assembly comprising a pair of transversely-spaced transfer arms 28 whose lower ends are pivotally connected at 30 to the respective side frame members and whose upper ends have recesses 32 to receive a roll shaft 20. A hydraulically operated piston and cylinder assembly 34 is pivotally connected between each transfer arm 28 and the respective side frame member 10 at 36 and 38 respectively for transferring a new roll from the loading position to the unwinding position as will also be described in more detail later.

Adjacent the rear end of the tracks 12, the machine has an unwinding roller 40 mounted on a shaft 42 extending transversely across the machine and whose opposite ends are rotatable mounted in bearings in the side frame member 10. The unwinding roller 40 is driven by a motor 44 connected by belt drive 46 to a drive pulley 48 mounted on one end of the roller shaft 42. It will be noted that the belt drive 46 passes around idler rollers 50, 52.

A raising assembly 54 is rotatable mounted on unwinding roller shaft 42 and comprises a pair of side arms 56 each rotatable mounted at one end on shaft 42 and carrying at the other end a support arm 58. The raising assembly 54 also includes a pair of rollers 60, 62 extending between the side arms 56 and with opposite ends rotatable mounted therein. The raising assembly 54 carries a cutting assembly 64 also extending between the side arms 56 and incorporating a knife 65 which when actuated cuts the strip. The construction and operation of the cutting assembly may be as described in my U.S. Pat. No. 4,748,884 issued Jun. 7, 1988 (see especially FIG. 7), or my recently filed co-pending application Ser. No. 07/978,546, filed Jan. 7, 1993 entitled "Cutting Assembly" the contents of which are hereby incorporated herein by reference. The raising assembly 54 is rotatable about shaft 42 by a motor 55 connected thereto by a belt drive 57.

A removal assembly 66 is located near the unwinding roller 40 and comprises a pair of removal arms 68 (only one of which is shown) each pivotally connected at 70 to a respective side frame member 10. The removal arms 68 have recessed ends 72 to receive opposite ends of the shaft 20 and are movable between a roll and shaft receiving position and a removal position by piston and cylinder assembly 74 pivotally connected at 76, 78 between the removal arms 68 and the side frame members 10. A piston and cylinder assembly 75 to dampen motion of the removal arms 68 is also provided.

The machine also has guide rollers 80, 82 over which the strip passes when leaving the machine. The guide roller 80 maintains the strip in engagement with a lower portion of the circumference of the guide roller 40 after it is unwound from the roll.

FIG. 1 shows a web 84 of plastic film being unwound from an almost empty roll 86. The opposite ends of the shaft 20 of roll 86 are supported by the tracks 12 and are located in the recesses 32 of transfer arms 28 which urge the roll 86 against unwinding roller 40 so as to be rotated thereby. After leaving the roll 86 the web 84 travels around the lower portion of the circumference of unwinding roller 40, being guided thereover by a roller 80. After passing around subsequent roller 80, 82, the web 84 leaves the unwinding machine for feeding to a further machine such as a printing machine or a laminating machine.

At this stage in the operation of the machine, the raising assembly 54 and the removal assembly 64 are in the inoperative positions shown in FIG. 1. Since the roll 86 is almost empty, a new roll 86' has been positioned on the floor adjacent the front end of the machine with opposite ends of its shaft engaged in the recesses 18 in the upper ends of loading arms 14.

Figure 3:
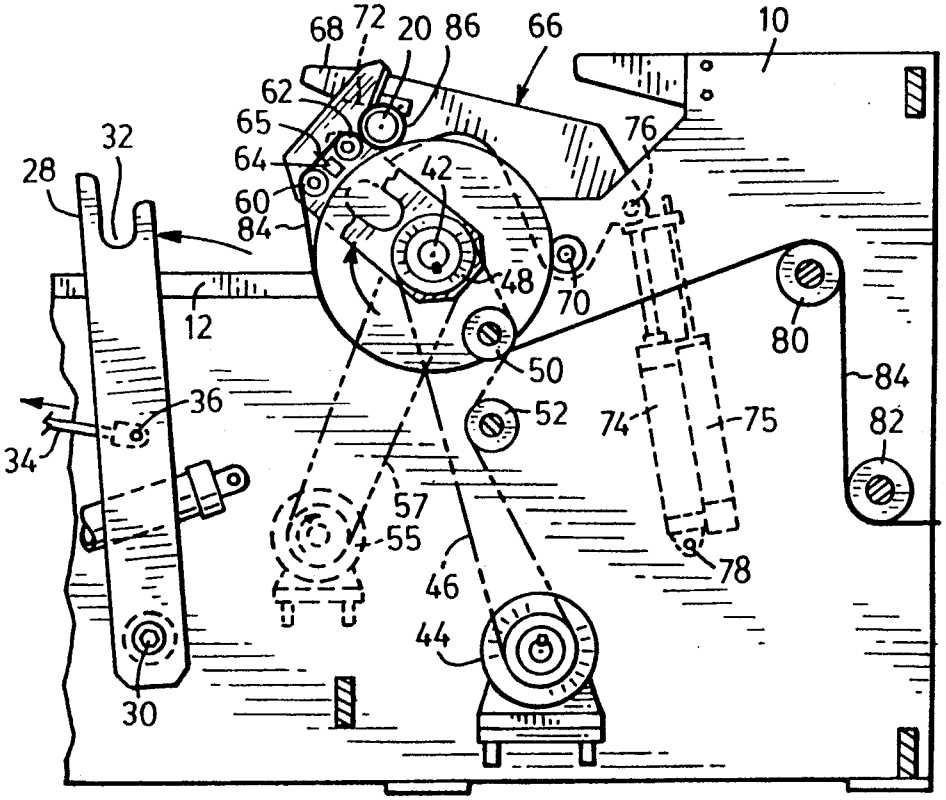
FIG. 3 is a similar view showing the nearly empty roll and shaft being raised by the raising assembly from the tracks and the transfer assembly and being engaged by the removal assembly.
Figure 2:
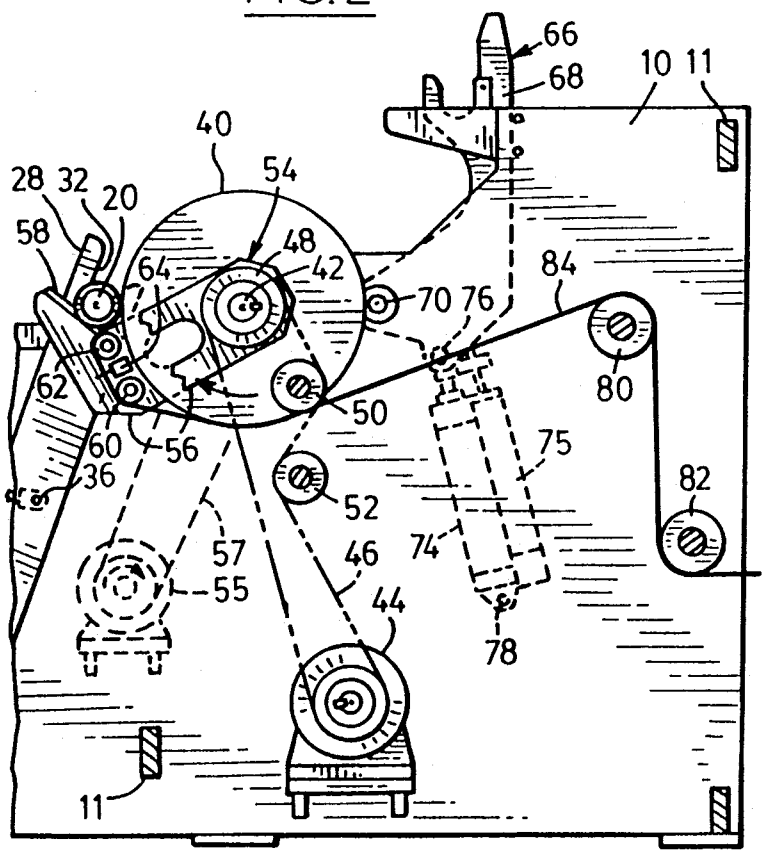
FIG. 2 is a similar view showing the roll being engaged by the raising assembly.

As shown in FIG. 2, the raising assembly 54 is then rotated clockwise by approximately 240° to position the junction of the side arms 56 and support arms 58 beneath and in engagement with opposite ends of the shaft 20 of the nearly empty roll 86. Referring now to FIG. 3, raising assembly 54 is then rotated clockwise by a further approximately 70° to lift the roll 86 and the shaft 20 upwardly from the tracks 12 and transfer arms 28 and move the roll 86 a short distance around the circumference of unwinding roller 40, i.e. from the 9 o'clock position shown in FIG. 2 to the approximately 11 o'clock position shown in FIG. 3. At the same time, the removal assembly 66 is rotated anti-clockwise by about 90° by entending the piston and cylinder assembly 74 from the position shown in FIG. 2 to the position shown in FIG. 3 so that the ends of shaft 20 of nearly empty roll 86 are received in the recesses of removal arm 68. The roll 86 and shaft 20 are thus held in the 11 o'clock position jointly by the raising assembly 54 and the removal assembly 66; It will be noted that to achieve this action, some initial over-rotation of the removal assembly 66 will be necessary to position the shaft 20 in the recesses 72 in the removal arms 68 as the raising assembly approaches the 11 o'clock position. Thus, web 84 is continued to be unwound from roll 86, now passing around a greater portion of the circumference of unwinding roller 40. Piston and cylinder assembly 34 is then contracted to swing the transfer arms 28 from the unwinding position shown in FIG. 2 to the loading position shown in FIG. 4.

Figure 4:
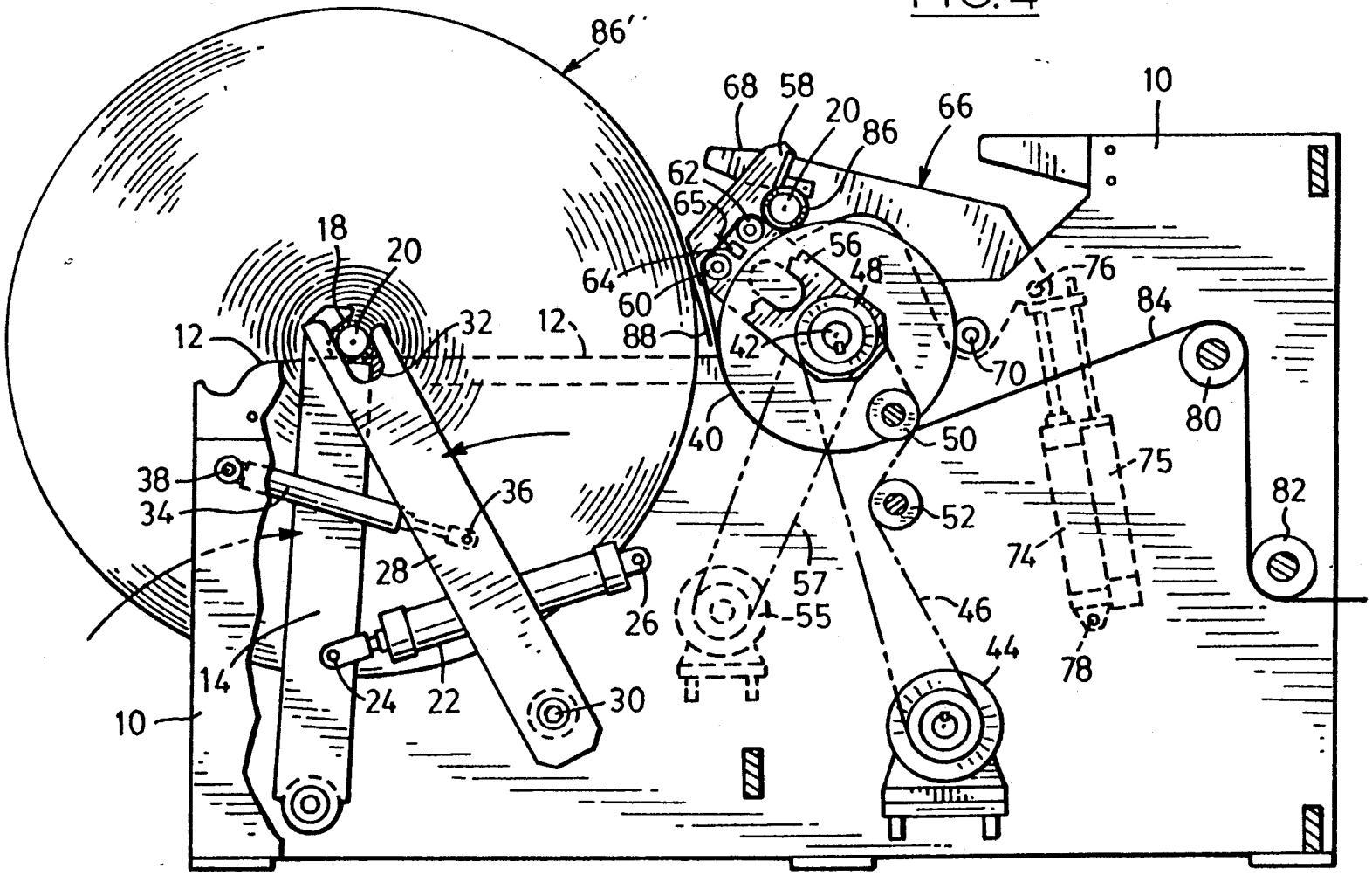
FIG. 4 is a similar view showing a new roll being loaded on the machine and approaching the unwinding position.

As shown in FIG. 4, the new roll 86' is then loaded on to the tracks 12 by contracting the piston and cylinder assembly 22 to swing the loading arms 14 upwardly from the position shown in FIG. 3 to the position shown in FIG. 4, thereby lifting up the new roll 86' and positioning the ends of its shaft 20 on tracks 12. At the same time, the shaft ends engage in recesses 32 of transfer arms 28 with piston and cylinder assembly 34 being slightly extended at this time to achieve such engagement and to position the circumference of the new roll 86' close to the unwinding roller 40, for example about 1 inch (2.5 cm) away. During such movement, the shaft ends leave the recesses 18 in the loading arms 14. The leading end of the web 86 on the new roll 86' is provided with an adhesive strip 88 which is positioned in proximity to the unwinding roller 40.

Figure 5:
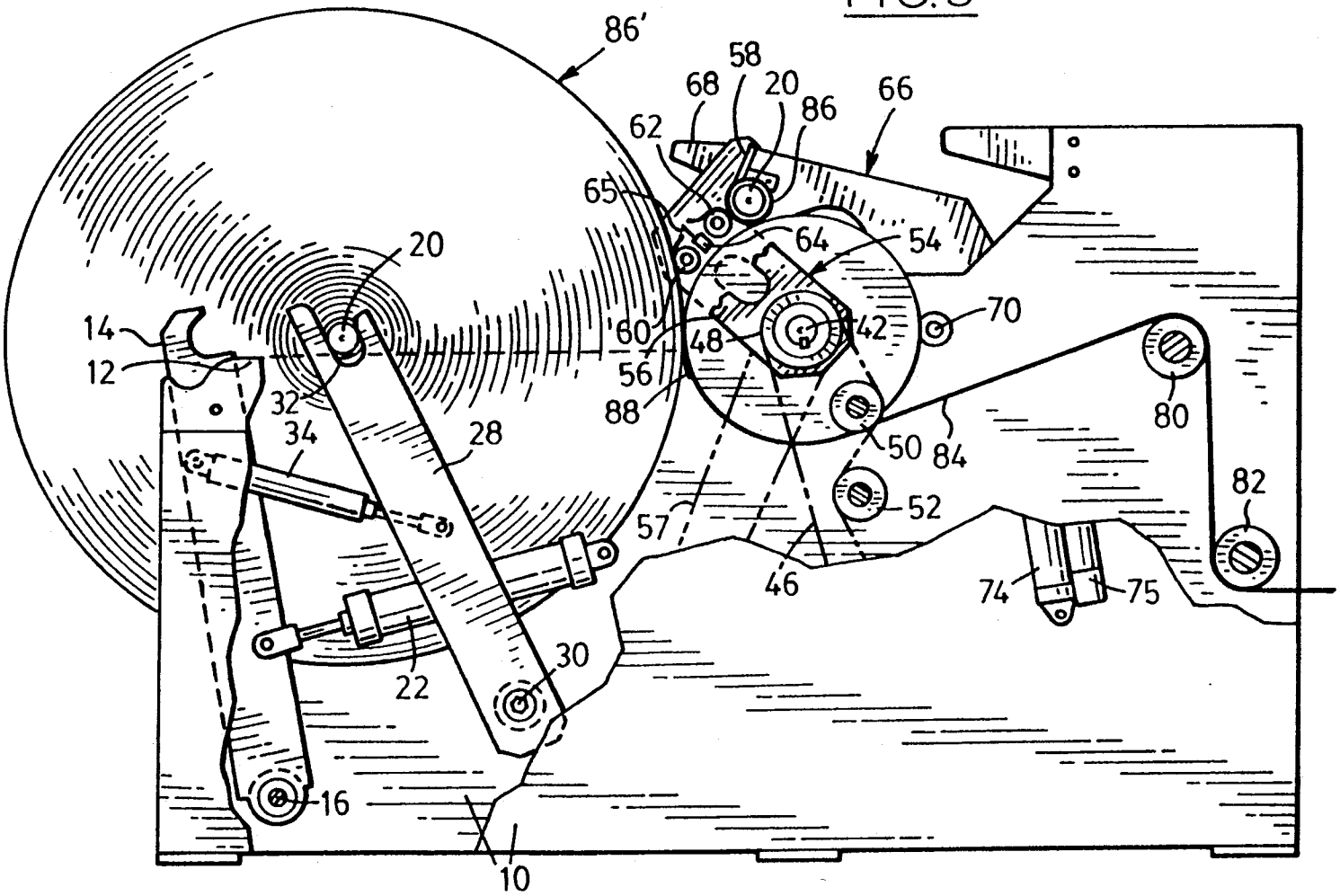
FIG. 5 is a similar view showing the strip from the nearly empty roll being cut and the trailing end portion of the strip being adhesively secured to the leading end portion of the strip from the new roll.

The new roll 86' is then moved into engagement with the unwinding roller 40 so that the adhesive strip 88 engages and adheres to the web 84 from the previous roll 86, see FIG. 5. At the same time, the cutting assembly 64 is activated to cut the strip 84 from the previous roll 86. Thus, the web 84 fed from the machine is continuous, with web now being unwound from the new roll 86' and with there being only a short length of double thickness in the region of the adhesive strip 88.

Figure 6:
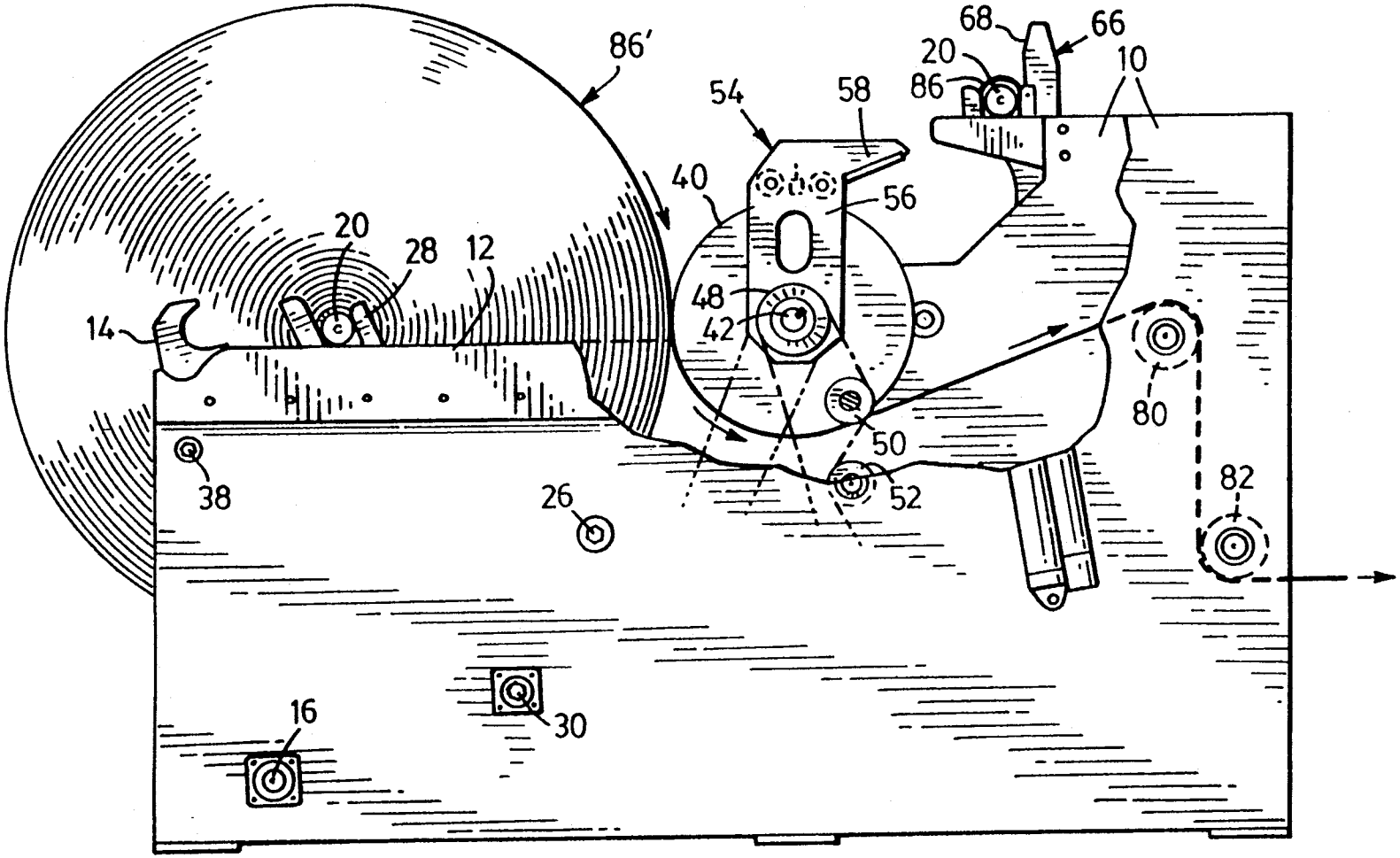
FIG. 6 is a similar view showing strip being unwound from the new roll, and the nearly empty roll and shaft being removed by the removal assembly.

Referring now to FIG. 6, removal assembly 66 is now rotated back to its original removal position and cutting assembly 54 is rotated further in the clock-wise direction so that it is returned to its original position. Nearly empty roll 86 and its shaft 20 can then be lifted out of the removal assembly 66 in any suitable manner.

Other embodiments of the invention will be readily apparent to a person skilled in the art, the scope of the invention being defined in the appended claims.

I claim:

1. A strip unwinding machine for supplying a continuous strip of thin flexible material by unwinding strip from successive rolls thereof, comprising:

a pair of laterally spaced tracks for receiving opposite end portions of a shaft on which a roll of strip is mounted, a transfer assembly for moving a roll and shaft along said tracks from a loading position to an unwinding position, a rotatable unwinding roller at the unwinding position, means for rotating the unwinding roller, said transfer assembly also being operable to urge the roll against the unwinding roller and cause the roll to be rotated thereby with consequent unwinding of the strip from the roll, at least one guide roller to guide the unwound strip around a portion of the unwinding roller and then out of the machine, a raising assembly operable to raise the roll and shaft at the unwinding position upwardly from said tracks and from said transfer assembly, when said roll is nearly empty, while maintaining engagement of the roll with the unwinding roller to enable a new roll and shaft to be brought to the unwinding position by the transfer assembly, and a cutting assembly operable to cut the strip from the nearly empty roll when the new roll is brought into engagement with the unwinding roller by the transfer assembly to cause the last portion of the strip unwound from the nearly empty roll to adhere to an initial portion of the strip on the new roll so as to continuously feed strip from the machine, the cutting assembly being carried by the raising assembly, and the raising and cutting assemblies being mounted for rotation around the unwinding roller so as to rotate completely therearound to effect changeover of strip feed from the nearly empty roll to the new roll.

2. A strip unwinding machine according to claim 1, wherein the raising assembly comprises a pair of side arms on opposite sides of the unwinding roller and each having an end mounted for rotation about the axis of rotation of the unwinding roller and a pair of support arms at the other ends of the side arms for raising a nearly empty roll and shaft from the tracks and from the transfer assembly by engagement with opposite ends of the shaft, said cutting assembly comprising a knife mounted between the side arms and operable to cut the strip.

3. A strip unwinding machine according to claim 2, including a removal assembly operable to remove a nearly empty roll and shaft from the raising assembly when the cutting assembly has operated to cut the strip.

4. A strip unwinding machine according to claim 3 wherein the removal assembly comprises pivotally mounted arms engagable with opposite ends of the shaft of the nearly empty roll.

* * * * *